United States Patent [19]

Kristen et al.

[11] 4,130,104

[45] Dec. 19, 1978

[54] GLOW WIRE IGNITION WITH ON/OFF AND HOT WARNING MEANS FOR GAS HEATED STOVE

[75] Inventors: Klaus Kristen, Wiesbaden; Herwig Scheidler, Finthen, both of Germany

[73] Assignee: JENAer Glaswerk Schott & Gen., Germany

[21] Appl. No.: 832,235

[22] Filed: Sep. 12, 1977

[30] Foreign Application Priority Data

Sep. 14, 1976 [DE] Fed. Rep. of Germany ..... 2641274

[51] Int. Cl.[2] ..... F24C 3/04

[52] U.S. Cl. ..... 126/39 J; 431/13

[58] Field of Search ..... 126/39 H, 39 J, 214 A; 431/13, 14, 328, 66

[56] References Cited

U.S. PATENT DOCUMENTS 2,870,828 1/1959 Hess ..... 126/39 H 3,968,785 7/1976 Perl ..... 126/39 J 4,083,355 4/1978 Schwank ..... 126/39 J

FOREIGN PATENT DOCUMENTS 7705338 5/1976 Netherlands ..... 126/39 J

*Primary Examiner*—Edward G. Favors

*Attorney, Agent, or Firm*—Hill, Gross, Simpson, Van Santen, Steadman, Chiara & Simpson

[57] ABSTRACT

A glowing wire type electric lighter or ignition system for a burner assembly in a gas heated stove having a vitreous ceramic cooking plate is provided. The system incorporates a direct warning indication not only that the associated burner assembly is "on" or "off", but also that the heated zone region of the cooking plate over such burner assembly remains too hot to be safely touched after such burner assembly has been switched off until such heated zone region has cooled to a predetermined harmless temperature.

16 Claims, 2 Drawing Figures

GLOW WIRE IGNITION WITH ON/OFF AND HOT WARNING MEANS FOR GAS HEATED STOVE

BACKGROUND OF THE INVENTION

This invention lies in the field of gas heated stoves or ranges incorporating a vitreous ceramic hot plate whereunder is positioned at least one burner assembly. Each burner assembly utilizes an electric light or ignition device of the glowing wire type.

Depending on the nature of the cooking process and on the quality of utensils used, the topside, (that is, the side facing a user) of a gas-heated vitreous ceramic hotplate may heat up to temperatures of the order of 550° C. The low thermal conductivity of conventional vitreous ceramic materials precludes fast heat dissipation of accumulated heat laterally through the hotplate away from the cooking zone region in the cooking zone region when a cooking procedure has been terminated. The cooling of hot cooking zone regions in a hot plate occurs substantially by convection to the airflow sweeping over the surfaces of the hotplate region. Consequently, it takes generally between about 40 and 60 minutes for such a heated hotplate area of cool to a reasonably safe temperature (e.g. below about 100° C.). For a user's safety, it is therefore highly important that the "hot" condition of a cooking zone region of a vitreous ceramic hotplate should continue to be visibly indicated even after an adjacent associated burner has been switched off until after the plate itself has cooled to a safe-to-touch temperature (e.g. about 60° C. or below).

Owing to the stored thermal energy in a heated cooking zone region of a vitreous ceramic hot plate, it is possible, especially at low temperature, or slow cooking stages, for the intervals of time between successive "on" phases of an associated adjacent burner to be of the order of 10 minutes, or even longer, so that a user may easily be mistaken in thinking that such a burner has been previously switched off. Moreover, a warning light would provide a constant warning signal as to the prevailing operative state of a burner at the actual burner side adjacent the cooking zone region and would also reduce the risk of such a burner being accidentally left "on" after cooking has been completed.

Since a gas jet burner characteristically shows its normal glow-pattern only after an initial starting up period of approximately 60 seconds and since, before then, a burner appears to be dark underneath its associated vitreous ceramic hotplate, it is an advantage to provide an immediate signal in the vicinity of the burner site to show a user that the burner is switched "on", as this will assist the user in the correct placing of cooking pans and also in the immediate detection of an accidentally switched-on burner.

The gas jet burner which is covered by the vitreous ceramic hotplate is automatically controlled and burns within a fully enclosed space with associated exhaust flue. It is of vital importance that the ignition of such a burner should be utterly dependable under any circumstances, that is to say, not only when the cooker switch is moved to the "on" position, but also during an intermittent, cyclic operation of the burner which is required to maintain pre-selected energy stages. For this purpose, it is currently common practice to provide a high-tension spark igniter. Igniters of the glowing wire type, on the other hand, are less commonly used in the prior art.

While spark igniters, in view of the inevitably very brief spark duration, are not themselves suitable to act at the same time as warning or position indicator devices, it is possible to combine an "off/on" warning signal function with the ignition function in the case of an electric lighter of the glowing wire type.

BRIEF SUMMARY OF THE INVENTION

The present invention provides a combination of a gas lighter system of the glowing wire type with a gas burner assembly and suitable circuit-and switch-control elements in such a way that the lighter system is an exchangeable (or replaceable) component part of the gas burner assembly as such. By virtue of its location in the burner assembly, and by virtue of its temperature characteristics when in operation, such gas lighter system ensures an absolutely dependable ignition of the burner jet in all operative conditions. In addition, at the same time, such gas lighter system performs the additional functional services of both a temperature warning indicator and an "on off" position indicator device at the burner site. Furthermore, this gas lighter system may also be adapted to shut off the gas supply to the burner assembly in the event that the glowing wire, or filament, becomes defective.

An object of this invention is to overcome the disadvantages of prior art ignition devices in gas heated cookers employing vitreous ceramic cooking plates and to provide an improved burner subassembly and gas heated stove or range.

Another object is to provide in a burner subassembly an improved ignition device having an "on/off" indication and also a temperature warning indicator.

Another object is to provide in a burner subassembly and associated gas stove a safety-equipped improved slow wire type ignition system.

Other and further objects, purposes, advantages, aims, utilities, features and the like will be apparent to those skilled in the art from a reading of the present specification taken together with the drawings.

DETAILED DESCRIPTION

Figure 1:
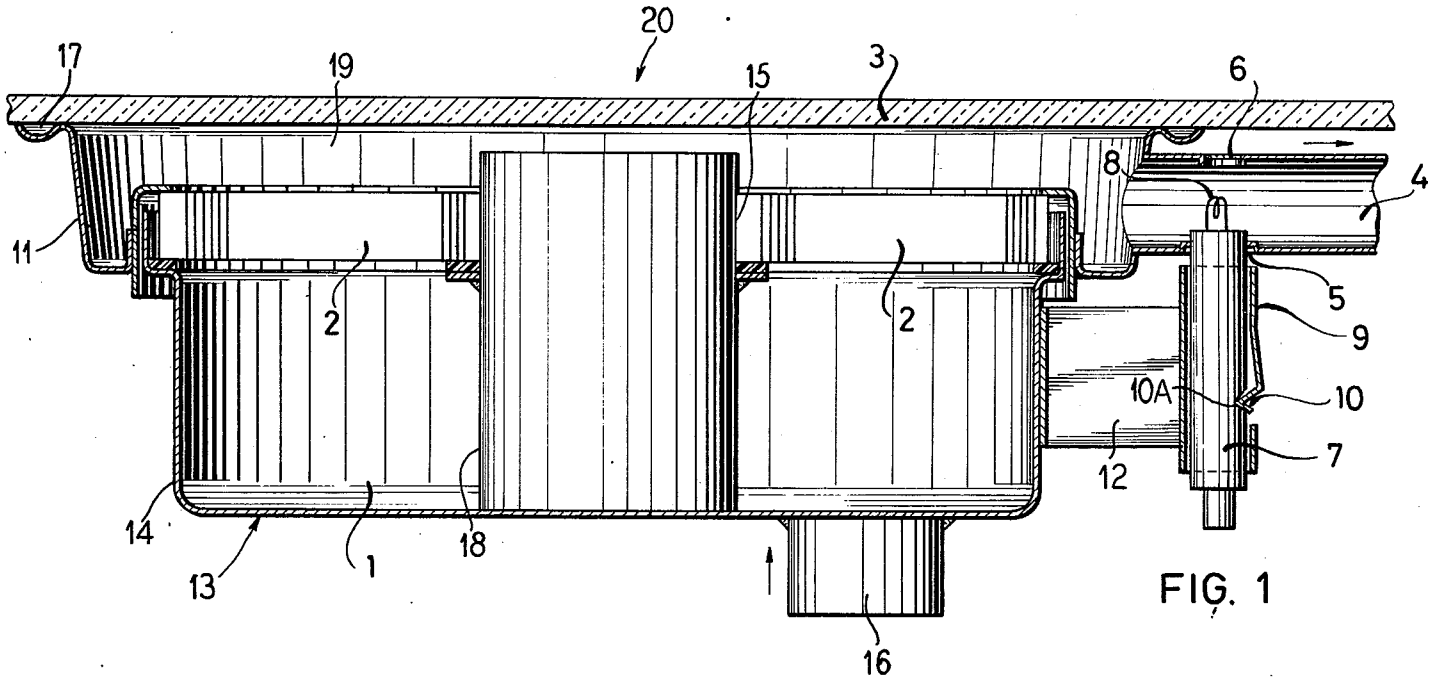
FIG. 1 is a vertical sectional view of one embodiment of an automatic, gas heated, glass-ceramic stove assembly of this invention incorporating a single embodiment of a burner subassembly of this invention, some parts thereof broken away and some parts thereof shown in section.

The glowing wire type ignition system is an exchangeable or replacable component part of a burner assembly and such system is additionally adapted to provide a direct warning or indication in the cooling zone region of the associated adjacent vitreous ceramic hotplate as to whether or not the burner assembly is "on" or "off". Moreover, the ignition system remains operative as a warning signal while such hot cooking zone region is still too hot to be safely touched (as by a human hand), even though the burner assembly has been switched off by an operator, until such cooking zone region of the hotplate has cooled to a harmless (safe) touching temperature.

The invention utilizes a glowing-wire lighter system wherein the glowing wire, or filament, has a strongly positive thermal coefficient with regard to electrical wire resistance, which is of the order of at least about 1.3Ω/° C. This filament is connected in such a way that it can be readily fitted as an exchangeable (or replacable) component part of the gas jet burner assembly in the inlet region of the exhaust flue from the burner assembly. The exhaust flue wall is provided with a window which is situated opposite the glowing filament of the lighter and so located that the hot lighter is clearly visible through the translucent vitreous ceramic hotplate. A temperature sensor element, such as a rod-extension switch, a bimetallic switch, or a thermo-element, or the like, in conjunction with an appropriate amplifier means ensures that, when the hotplate is switched off, the current supply to the lighter system is discontinued only after the associated cooking zone region of the hot plate has actually cooled to a safe, low temperature, of, for example, about 60° C. The term "hot plate" is sometimes used to mean "cooking plate" herein.

Conveniently, the operating temperature of the glowing-wire, or filament, is between about 1200° C. and 1500° C. When the lighter system is also chosen to function as an ignition safety device, it is associated, for example, with a magnetically actuated gas valve which is (opened) by the operative current flowing through the glowing wire. This valve is preferably located in the gas supply line to the burner assembly forwardly of the main gas valve for the associated burner, and is adapted to shut off the supply of gas to the burner assembly in question when and if the filament wire should burn through.

The very high temperatures in the actual burner space and in the adjacent surrounding region around the burner assembly militates against the use of filament bulbs or glow-lamps, even in combination with light conductors, or reflectors, so that the brightly glowing filament of the lighter system filament is indeed the most suitable means for producing the desired signal function immediately at the burner operating site.

In addition to the advantage of providing a direct and simultaneous indication or signal of the operative state of the burner assembly, the electric, glowing wire-type lighter systemm presents a series of further advantages as compared with, for example, a high-tension spark igniter. For one thing, the operative voltage of a glow-wire igniter is of the order of 1.5 to 5 V. which eliminates all problems connected with insulation which are liable to arise with regard to the high-tension leads for spark igniters under the prevailing high temperatures. The high temperatures to which the insulations of the high tension leads are subjected may give rise to leakage currents with the result that the ignition spark, while still present, may be too cold to ignite the gas-air mixture because the ignition current has been excessively weakened. A glowing wire or filament does not give rise to high-frequency interference pulses which must be counted as a major advantage in burner assembly operation, especially where a burner assembly is controlled by an electronic control unit, because such permits all of those circuit components to be eliminated in the electronic control unit which were otherwise required to suppress interference pulses introduced by the ignition spark. Since the suppression of such interference entails a considerable outlay, the omission of these components means permits the electronic unit utilizable in the practice of this invention to be substantially less expensive when associated with a glow-wire lighter device than when used in conjunction with a spark igniter device.

For another thing, the operative current for the glow-wire lighter device is of the order of 2 to 6 amperes, and this current is sufficiently strong to actuate a gas flow safety valve in series with the lighter device. No comparable and simple, economically priced system can be achieved for spark-igniters. The same analysis applies with regard to the further control functions used when employing conventional electro-mechanical parts.

The reliable and faultless performance of the ignition function by the glow-wire as employed in this invention is essentially influenced by three factors:

1. The location of the glow-wire in the burner space. such location must be governed by the flow-dynamics of the burner prior to the ignition of the gas-air mixture and takes into account the permitted maximum operative temperature of the ligher.
2. The temperature/resistance characteristic of the resistance material of this glow-wire. The thermal coefficient of the wire must be positive and sufficiently high for the wire to compensate automatically for any cooling action of the gas-air-mixture flow to which it is exposed so that a correspondingly increased intake of current at a constant operative voltage (automatic control of glow-wire temperature) results by cooling action.
3. The operative temperature of the glow wire. This temperature must be above 1200° C. to safeguard ignition in absolutely reliable manner.

In a cold gas jet burner covered by a hotplate, the gas air mixture flows away from the edge of the burner jetplate by the shortest way to the exhaust flue. Consequently, a glowing wire lighter system, which is fitted at the edge of this plate for reasons of its permitted operative temperature level, will not have sufficient contact with the gas-air mixture to ignite the same. At the exhaust flue inlet on the burner side, on the other hand, there is a slightly raised pressure in the gas-air mixture. When the lighter is mounted in this position or location, it has good contact with the gas-air mixture and therefore ensures reliable and safe ignition.

Alternatively, the glowing wire lighter system can be arranged in the jet plate which is sufficiently cooled at its underside by the gas-air mixture to keep the temperature-sensitive connecting leads for the glowwire, which must then be positioned beneath the jet plate, adequately cool. In this position, the lighter also ensures dependable ignition of the mixture, but this arrangement has the obvious drawback that, when a pan is placed on the hotplate, the glowing wire is no longer visible and cannot, for this reason, continue to function as a position indicator, or signal, while cooking is in progress, as desired.

Referring to FIG. 1, there is seen a transparent, vitreous ceramic cooking plate or hotplate 3 which functions as a radiant cooking surface. Beneath plate 3 is located a gas heated radiation burner subassembly 13. Burner subassembly 13 includes a housing 14 which can be formed of metal, and a perforated burner plate 2 which is mounted across the open upper portion of the housing 14 as by a clamping arrangement, or the like. A burner chamber is defined by housing 14 and plate 2. The burner plate 2 has a generally circular perimeter and has a central axial opening 15 formed therein. A bottom wall portion of housing 14 interconnects by welding or the like with a mixer pipe 16 at the terminal end thereof, the other end (not detailed) of mixer pipe 16 being interconnected with a nozzle (not shown). An exhaust gas ring 11 extends circumferentially of burner plate 2, ring 11 being formed of metal, or the like. The ring 11 is here secured by an inturned lip to an upper edge portion of the housing 14 as by welding, or the like, and ring 11 thus circumferentially circumscribe a combustion chamber 19 otherwise generally bounded by plates 2 and 3.

The upper circumferential edge portion of the exhaust gas ring 11 is adapted to engage against the flattened underside of the glass ceramic cover plate 3 in a resilient or elastic fashion through intermediate bonding provided by a temperature resistant flexible elastic sealing ring 17 which bonds ring 17 to plate 3 and serves to support and suspend the burner subassembly 13. The spring action thus provided by ring 17 ensures a flexible yielding action between plate 3 and burner subassembly 13 in the event of a deflecting load exerted on the exposed face of cover plate 3. Except for apertures as herein described, the housing 14, the ring 11 and the cover plate 3 are preferably in a gas-tight interrelationship and interconnection with one another.

In ring 11 an aperture is formed to which is connected an exhaust gas flue 4 whose free cross sectional area is preferably so dimensioned as to render it adapted to conduct therethrough unimpededly exhaust gases discharged from the region generally between plate 3 and plate 2. Because of the height of the exhaust gas ring 11 a constant distance between the plate 2 and the plate 3 is maintained with adjacent surfaces of these respective bodies being in a generally spaced, parallel relationship to one another.

Through opening 15 a pipe 18 extends upwardly from the bottom wall portion of housing 14. Within pipe 18 are conveniently mounted conventional and known control means for regulating and controlling normal operational modes of burner subassembly 13 as necessary or desirable; such control means do not form part of the present invention, but examples include temperature limitation means, and ignition safeguard means. By selecting an operating temperature range between a low value (controlled by the ignition safeguard means, for example) and a high temperature (controlled by the temperature limitation means, for example), an operator of a stove having incorporated thereinto a plate 3 and associated burner subassembly 13 thus controls the temperature at which a particular species of food is to be cooked on the upper face of plate 3 in the cooking zone region overlying such burner subassembly 13. Any desired arrangement can be used, as those skilled in the art will appreciate.

An opening 5 in flue 4 accomodates the upper end region of a glowing wire igniter unit 7 which is provided with a glowing wire filament 8 here wound as a small helix. Filament 8 is thus located in flue 4 in spaced, adjacent relationship to ring 11 and chamber 19. A display window 6 is formed in flue 4 opposite opening 5 adjacent plate 3 so that filament 8 visible when glowing through plate 3.

A bracket assembly 12 here formed of sheet metal is secured at one end thereof by welding or the like to housing 14. The other or outer end of bracket 12 has formed therein a channel 9 through which extends igniter unit 7. Channel 9 is provided wit a detent or notch 10 for locking with a mating notch 10A in igniter unit 7 so as to lock igniter unit 7 in a desired correct position for filament 8. A most favorable position for filament 8 in the exhaust gas flow through flue 4 was found to be where the center of the helical filament coincides with the middle of the exhaust gas stream in flue 4. While, in its simplest form, window 6 may be just a bore or drilled hole in flue 4, an additional covering of this window by a clear transparent vitreous ceramic material is possible, but not essential.

Figure 2:
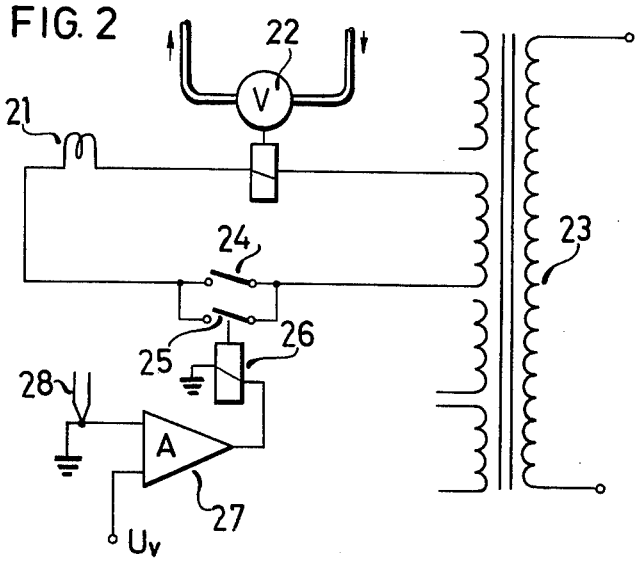
FIG. 2 shows a schematic diagram of one embodiment of an electric circuit adapted for use with the apparatus shown in FIG. 1.

FIG. 2 illustrates one circuit embodiment of the many possible operational variations which can be used in an operating and control circuit for an igniter unit 7 functioning as a temperature or "hot" warning device and as an off-on indicator, and also optionally for linking the gas supply with a safety valve in such a way as to shut off the flow of gas to burner subassembly 13 and pipe 16 in the event of fracture of the wire filament 8. This circuit embodiment is employable in combination with a conventional circuit arrangement used for stove burner subassembly operation.

As shown in FIG. 2, a filament 21 is connected in series with a contact switch 24, with one secondary winding of a transformer 23, and with the solenoid winding of an electromagnetically operated safety valve 22. Contact switch 24 is also coupled to a main switch assembly (not detailed) for an entire stove 20 which incorporates in this illustration, a single hot plate (or cooking plate) and four burner subassemblies, each such burner subassembly being similar to that shown and described above in reference to FIG. 1 and designated by the numeral 13.

Closing switch 24 actuates valve 22. An amplifier or comparator 27 controls operating of relay 126. A heat sensing element 28 (which is associated with each respective burner subassembly 13) is connected to comparator 27, and a reference voltage source $U_V$ is likewise connected to comparator 27, the value of voltage being fed by source $U_V$ to comparator 27 being representative of a predetermined maximum temperature value selected up to a permissible maximum value for a given burner subassembly (selection being by an operator of the stove 20).

Thus, when a burner subassembly 13 is switched on, the electric circuit for the glowing wire 21 is closed on the secondary side of transformer 23 by the contact switch 24 (which is coupled with the main switch (not shown), via the windings of the electromagnetically operated valve 22. Valve 22 is provided as a safety valve preceding the main control valve (not shown) for each burner subassembly 13. The safety valve 22 opens, and the glowing wire filament 21 achieves its operative temperature, after about 3 seconds whereupon gas ignition occurs. In a stove with four burner subassemblies, the transformer 13 here has four secondary windings, one for each ignition circuit of the four burner stove, which is respectively activated together with each of the associated hotplates. The primary side of the transformer remains connected to the grid supply and the transformer "idles" or works under non-load conditions when the stove 20 is completely switched off.

The bi-pass briding contact switch 25 of relay 26 is switched on by the heat sensor 8 with the amplifer circuit 27 as soon as the hotplate temperature exceeds a predetermined limit. Preferably the amplifier circuit 27 is arranged as a comparator unit. In that case, the temperature trigger threshold for the bridging contact switch 25 is fixed by a reference voltage $U_v$ at the comparator input terminal. The additionally actuated contact switch 25 fulfils no function at all for as long as the main switch, and, therefore, the hotplate and contact switch 14 remains "on".

When, after cooking is finished, contact switch 24 is opened, and the burner is switched off, the ignition circuit through contact switch 25 remains intact until the temperature of the hotplate has dropped below a preselected threshold value in the comparator. Only then will the ignition circuit be interrupted, and the glowing wire 11 go "out" or dark.

Although the teachings of our invention have herein been discussed with reference to specific theories and embodiments, it is to be understood that these are by way of illustration only and that others may wish to utilize our invention in different designs or applications.

What is claimed is:

1. In a cooking stove assembly of the type having a transparent cooking plate in combination with at least one gas burner assembly, each such burner assembly having (a) a perforated burner plate which is located in fixed, spaced relationship to the underside of said cooking plate, (b) a wall means surrounding said burner plate and defining a heating chamber below said cooking plate, (c) an exhaust gas flue leading from an aperture in said wall means, (d) pipe means for delivering a combustible gas to said burner plate, (e) gas lighter means for igniting said gas, (f) adjustable valve means for controlling the flow of said gas in said pipe means, and (g) control means for operating each such burner assembly, including an "on-off" switch means for each such burner assembly, the improvement which comprises for each such burner assembly in combination (A) said gas lighter means comprises an igniter wire means electrically heatable to a glowing condition with low voltages and amperages, (B) mounting means for positioning said igniter wire means in said exhaust gas flue means in spaced, adjacent relationship to said heating chamber, (C) window means defined in said flue means and spatially located so that said igniter wire is visible through said cooking plate whenever said igniter wire is in such a glowing condition, (D) temperature sensing means for determining the temperature of said cooking plate in the region of said heating chamber and for generating a signal representative of the temperatures so sensed, (E) first electrical switch means and associated first electrical means for maintaining said igniter wire means in such a glowing condition whenever said burner assembly is operating, and (F) second electrical switch means, and second associated electrical means for maintaining said igniter wire in such a glowing condition whenever said cooking plate has a temperature which exceeds a predetermined value as sensed by said temperature sensing means.

2. The assembly of claim 1 wherein said mounting means demountably so positions said igniter wire means.

3. The assembly of claim 1 wherein said second associated electrical means includes a temperature control circuit.

4. The assembly of claim 1 wherein said first associated electrical means includes means for continuously maintaining said igniter wire in such a glowing condition even when an associated such burner assembly while functioning is operating intermittently through operation of said control means.

5. The assembly of claim 1 wherein in each said burner assembly said wall means generally said burner plate with said burner plate being disposed generally across an upper portion of said housing in spaced parallel relationship generally to the underside of said cooking plate, said wall means being secured to adjacent portions of said cooking plate by elastic sealing means so that said housing, said pipe means, said flue means, and said cooking plate generally are in a gas tight relationship with one another.

6. The assembly of claim 5 wherein said igniter wire means is supported by a bracket means extending from said wall means.

7. The assembly of claim 5 wherein detent means positions said igniter means relative to said bracket means.

8. The assembly of claim 7 wherein said detent means comprises notch means.

9. The assembly of claim 5 wherein said igniter wire means has a positive thermal coefficient.

10. The assembly of claim 5 wherein said igniter wire means includes a helically wound wire member in said gas flue means.

11. The assembly of claim 10 wherein the center of said wire member coincides generally with the center region of said exhaust flue.

12. The assembly of claim 3 wherein said temperature control circuit includes an amplifier circuit and relay means is associated with said second switch.

13. The assembly of claim 12 wherein said amplifier circuit is operated as a comparator unit whose operating threshold is determined by the value of an input reference voltage representative of a predetermined minimum voltage value.

14. The assembly of claim 1 wherein said mounting means extends through an aperture defined in a side wall portion of said flue means.

15. The assembly of claim 1 wherein said temperature sensing means is a bimetallic thermostat functioning as said second switch.

16. The assembly of claim 1 wherein said temperature sensing means is an expanding rod functioning as said second switch.

* * * * *